United States Patent [19]

Palmer

[11] Patent Number: 4,592,288

[45] Date of Patent: Jun. 3, 1986

[54] CYLINDER HEAD BURNER

[75] Inventor: Donald C. Palmer, Clackamas, Oreg.

[73] Assignee: U.S. Metal Works, Inc., Sandy, Oreg.

[21] Appl. No.: 695,689

[22] Filed: Jan. 28, 1985

[51] Int. Cl.[4] ..... F23G 5/12; F23G 5/06

[52] U.S. Cl. ..... 110/236; 110/246; 110/212; 432/105

[58] Field of Search ..... 110/236, 256, 246, 241, 110/210, 211, 212, 214, 248; 432/105, 107, 112–114, 117

[56] References Cited

U.S. PATENT DOCUMENTS

| | | | |
|---|---|---|---|
| 1,864,257 | 6/1932 | Purser . | |
| 2,058,388 | 10/1936 | Rendleman . | |
| 2,136,993 | 11/1938 | Palmgren | 432/186 |
| 2,288,980 | 7/1942 | Turin . | |
| 2,963,389 | 12/1960 | Winkler . | |
| 3,346,417 | 10/1967 | Erlich . | |
| 3,368,505 | 2/1968 | Harrison | 110/246 |
| 3,530,805 | 9/1970 | Bowman | 110/246 |
| 3,530,806 | 9/1970 | Bowman | 110/246 |
| 3,646,898 | 3/1972 | Bavers | 110/246 |
| 3,699,904 | 10/1972 | Brown et al. | 110/212 |
| 3,745,942 | 7/1973 | Thompson et al. | 110/211 |
| 3,762,858 | 10/1973 | Torrence . | |
| 3,780,676 | 12/1973 | Hazzard et al. | 110/212 |
| 3,792,671 | 2/1974 | Woods | 110/212 |
| 3,807,321 | 4/1974 | Stockman | 110/236 |
| 3,989,537 | 11/1976 | Sickmeier . | |
| 4,445,844 | 5/1984 | Matthews | 431/170 |

*Primary Examiner*—Henry C. Yuen

*Attorney, Agent, or Firm*—Kolisch, Hartwell & Dickinson

[57] ABSTRACT

The burner apparatus of the instant invention includes a forced air gas burner which directs a hot gas stream over an object to be cleaned in a burning chamber. The burning chamber includes a burner pipe for evenly distributing the gas stream throughout the chamber. An object-carrying basket is removably mounted in the chamber. A pollutant reduction chamber is connected to a burning chamber outlet and is constructed to reduce the content of pollutants in the gas stream which is subsequently released into the atomosphere.

12 Claims, 6 Drawing Figures

CYLINDER HEAD BURNER

BACKGROUND AND SUMMARY OF THE INVENTION

The instant invention relates to a device for cleaning metal objects. More specifically, the invention relates to a burner which is used to remove, by incineration, grease and other undesirable materials adhering to the object to be cleaned, while effectively controlling the level of pollutants emitted into the atmosphere. The burner features a removable object-carrying basket to facilitate placement and removal of objects in the burner. This description will deal primarily with burners specifically designed to clean cylinder heads. However, it should be appreciated that the invention has other applications which will become evident as this description continues.

Devices are known which may be used to elevate the temperature of a cylinder head which has been removed from an internal combustion engine thereby to remove grease and other foreign materials which adhere to the head. However, such devices are generally energy inefficient and additionally cause the introduction of unacceptable quantities of pollutants into the atmosphere. Generally, a cylinder head must be secured in the device, heated, and, after sufficient time has passed for the head to cool, removed from the device.

An object of the instant invention is to provide a cylinder head burner which is energy efficient.

Another object of the invention is to provide a cylinder head burner which does not emit unacceptable levels of pollutants into the atmosphere.

A further object of the invention is to provide a cylinder head burner which may be easily loaded and unloaded.

Another object of the invention is to provide a head-carrying basket for use in a cylinder head burner which will carry multiple cylinder heads for cleaning and which allows removal of cylinder heads from the cylinder head burner without the necessity of waiting for the heads to cool below their treatment temperature.

Another object of the invention is to provide a cylinder head burner which is easily and inexpensively manufactured and which is easy to maintain and is operable by persons with little training.

The cylinder head burner of the instant invention includes a forced air gas burner which directs a hot gas stream over an object to be cleaned in a burning chamber. The burning chamber includes a burner pipe for evenly distributing the gas stream throughout the chamber. An object-carrying basket is removably mounted in the chamber. A pollutant reduction chamber is connected to a burning chamber outlet and is constructed to reduce the content of pollutants in the gas stream which are subsequently released into the atmosphere.

These and other objects and advantages of the instant invention will become more fully apparent as the description which follows is read in conjunction with the drawings.

DESCRIPTION OF THE PREFERRED EMBODIMENT

Figure 1:
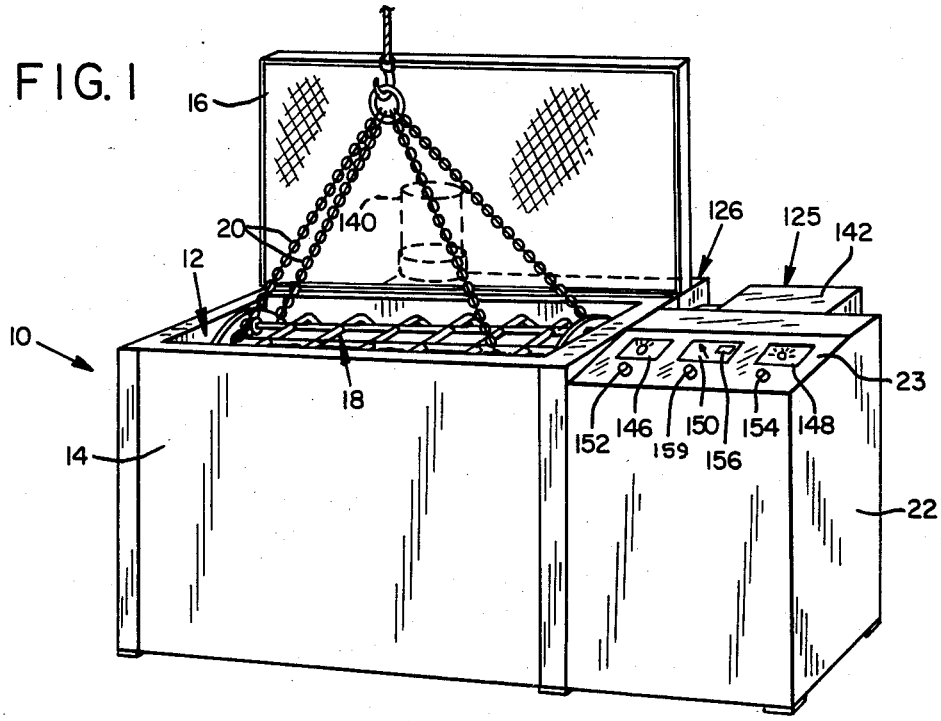
FIG. 1 is a perspectve view of a cylinder head burner constructed according to the instant invention.

Turning now to the drawings, a cylinder head burner is shown generally at 10 in FIG. 1. The burner includes a burning chamber, shown generally at 12. Chamber 12 is enclosed in a cabinet 14 which has a lid 16 which may be tightly closed.

An object or a head-carrying basket shown partially and generally at 18 is depicted inside chamber 12. Basket 18 may be removed from chamber 12. Basket 18 has attached to it a harness 20 which is in turn attached to a hoist (not shown). Harness 20 is used to insert and remove basket 18 in chamber 12. Details of basket 18 and its use will be described later herein. A second cabinet 22 is attached to cabinet 14. Cabinet 22 includes a control panel 23 on its upper surface and provides a housing for other components of the burner, to be described later herein.

Figure 2:
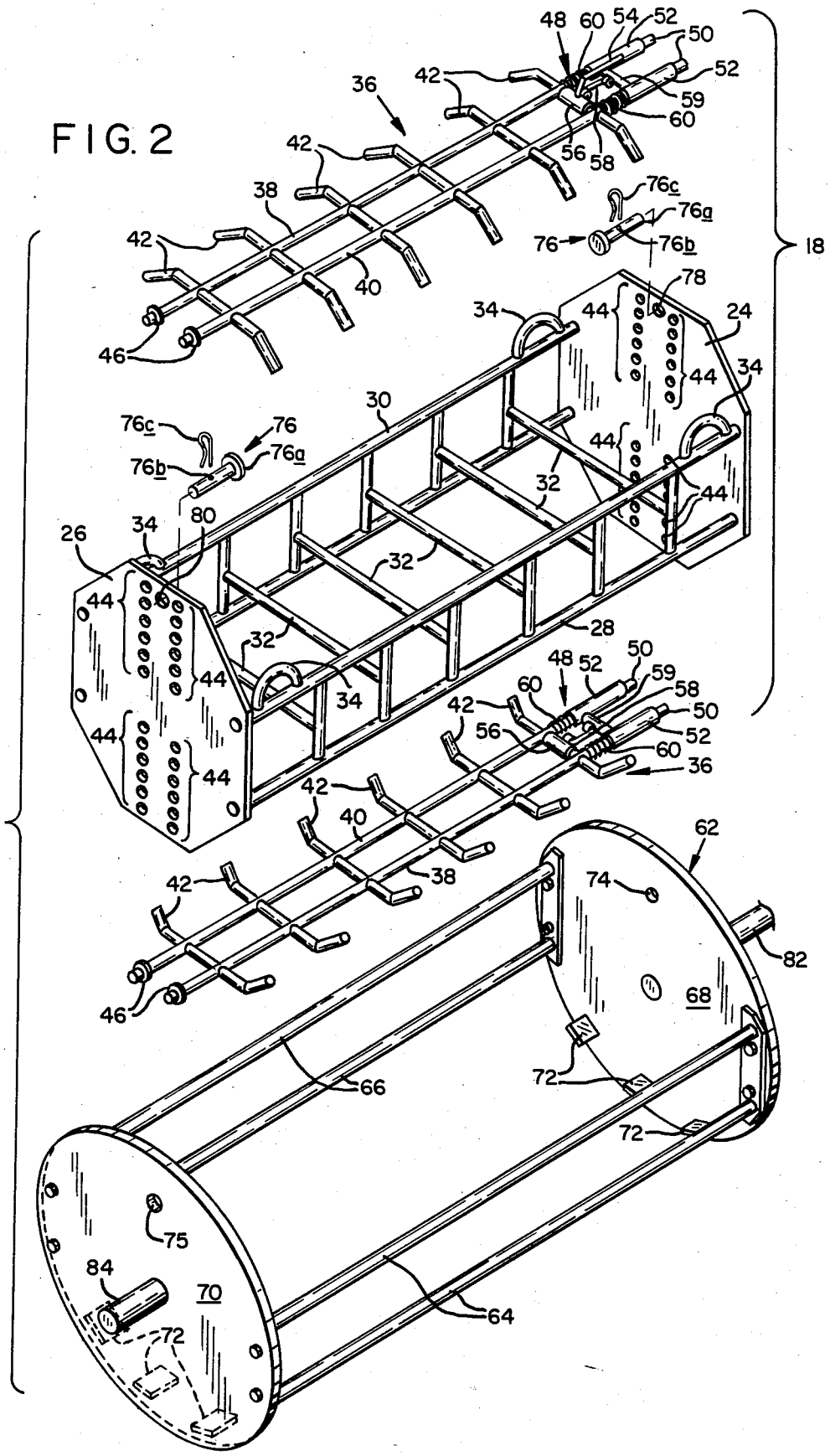
FIG. 2 is an exploded perspective view of a object-carrying basket and basket mount constructed according to the instant invention.

Turning now to FIG. 2, basket 18 is shown in an exploded view. Basket 18 includes a pair of spaced-apart end plates 24, 26, which are spaced apart by longitudinal basket-support means which extend between the end plates. Basket-support means include a pair of lateral, ladder-like structures 28, 30, extending between end plates 24 and 26 and cross members 32 extending between structures 28 and 30. Lifting eyes 34, for receiving harness 20, are located at each end of structures 28 and 30 adjacent end plates 24 and 26.

Block-retaining racks, shown generally at 36, are provided to secure the objects to be cleaned in basket 18. Rack 36, also referred to herein as fastening means, includes longitudinally extending, spaced-apart portions 38, 40, and transversely extending portions, shown at 42.

Rack 36 may be positioned on end plates 24, 26 by inserting the ends of portions 38, 40 into plural bores, shown at 44, which are located in the end plates and which are spaced to receive the ends of portions 38, 40. Abutments are provided on rack 36 to limit the travel of portion 38, 40 into end plates 24, 26. At one end of rack 36, the abutments take the form of washer-like structures 46 which are secured to one end of portions 38, 40, as by welding.

Figure 3:
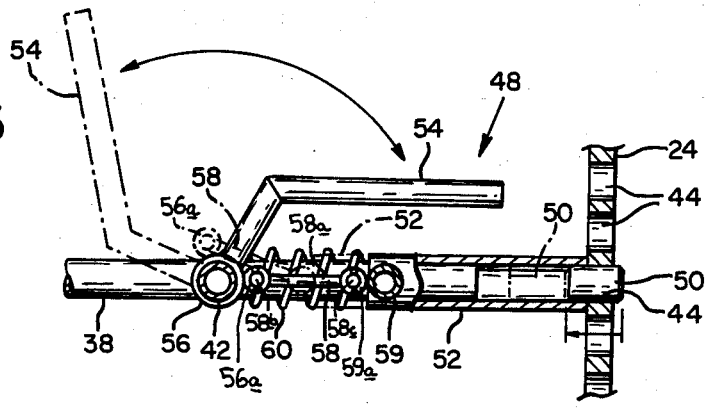
FIG. 3 is a fragmentary, enlarged side view of basket fastening means, with the fastening means also shown in a disengaged position in phantom lines.

Turning momentarily to FIG. 3, a spring-biased abutment, or spring-biased means, is shown generally at 48. FIG. 3 depicts the spring-biased abutment in a fixing position (solid lines) wherein a plug 50 is inserted in a bore 44. Plug 50 is carried on a sleeve 52 which is slidably movable on the other end of portion 38. Plug 50 and sleeve 52 comprise what is referred to herein as plug means. Another plug means is carried on portion 40.

A lever, or shiftable lever means, 54 is mounted for rotation on a portion 42 by means of a collar 56. Collar 56 has a bushing, or first pivotable means **56*a* fixed thereon. A connecting arm or connection means 58 includes an elongate portion 58*a* with lugs 58*b*, 58*c* at either end thereof. A cross-bar 59, or means joining, extends between sleeves 52 to facilitate simultaneous sliding of sleeves 52 on the ends of longitudinally extending portions 38, 40. Cross-bar 59 has a bushing, or second pivotable means 59***a* fixed thereon. Lugs 58*b* and 58*c* are pivotally received in bushings 56*a*, 59*a*, respectively. Lever 54, collar 56, connecting arm 58 and cross-bar 59 comprise what is referred to herein as means for shifting. Springs, or spring means, 60 are provided to urge plugs 50 to the fixing position.

Movement of lever 54 to the position shown in phantom lines results in movement of plugs 50 and sleeves 52 along portions 38, 40 by a distance indicated by the arrow in FIG. 3, and withdrawal of plugs 50 from bores 44. Abutment 48 is so constructed as to provide an over-center lock to retain plugs 50 in a releasing position to facilitate removal of rack 36 from basket 18.

Rack 36 is therefore removably fixable in the bores of end plates 24, 26 for securing a cylinder head to the basket. Spring-biased abutment 48 in conjunction with plural bores 44 allows positioning rack 36 on the end plates in a manner to provide securing of cylinder heads of varying sizes to basket 18.

Returning now to FIG. 2, a basket mount is shown generally at 62. Basket mount 62 includes spacers 64, 66 which are secured, at their ends, to mount end pieces 68, 70. Each end piece, in the preferred embodiment, has three basket-support dogs, shown at 72, fixed adjacent the periphery of the end piece. Basket keeper bores 74, 75 are formed in each end piece and each receives a basket keeper, shown generally at 76.

Each basket keeper, also referred to herein as removable basket mounting means, includes a flanged pin 76*a* having a pin receiving bore 76*b* in the shaft thereof. A resilient retaining pin 76*c* is received within bore 76*b* when the keeper is installed. Basket end plates 24, 26 have bores 78, 80, respectively, formed therein for receiving keepers 76. When basket 18 is placed in basket mount 62, end plates 24, 26 are supported by dogs 72 and basket 18 is fixed relative mount 62 and held in place by insertion of keepers 76 through bores 78, 80 in the basket and bores 74, 75 in the basket mount, respectively. Pins 76*c* are inserted in bores 76*b*, between the end plate and end piece to prevent withdrawal of keepers 76 from the combined basket and mount. Keeper 76 therefore provides means for removably mounting the basket in the chamber.

To complete the description of mount 62, idler shafts 82, 84 are fixed to end pieces 68, 70, respectively, and provide a means for rotatably mounting mount 62 within chamber 12. Mount 62 and basket 18 comprise what is referred to herein as basket means.

Figure 4:
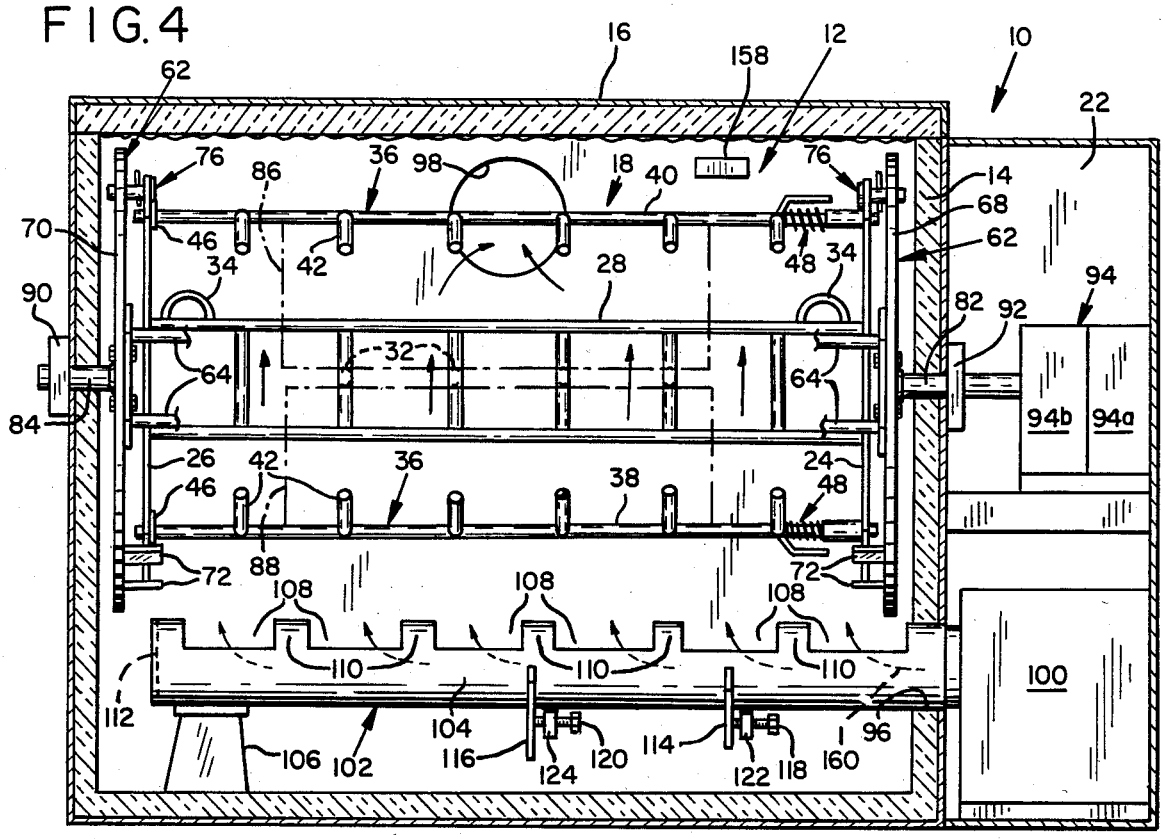
FIG. 4 is a front plan view of a cylinder head burner with portions broken away to show detail.

Turning now to FIG. 4, basket 18 and basket mount 62 are shown located in chamber 12. The basket and mount are depicted in an assembled condition with cylinder heads 86, 88 depicted in phantom lines and being placed ready for treatment in chamber 12. A bearing mount 90, which is of the saddle mount type in the preferred embodiment, is placed externally of chamber 12 and receives idler shaft 84 at one end of chamber 12. A second bearing mount 92 is located within cabinet 22 and receives idler shaft 82. Idler shaft 82 is operably connected to a drive unit 94 which is operable to rotatably drive basket mount 62 and basket 18 therewith. Drive unit 94, in the preferred embodiment, includes a one-quarter horsepower, constant speed, 110 volt a.c. motor 94*a* connected to shaft 82 through a gear reduction unit 94*b*. Motor 94*a* operates at 12 r.p.m. and gear reduction unit 94*b* provide a 72:10 ratio, causing mount 62 to rotate at approximately 1.7 r.p.m.

From the foregoing, it is apparent that basket 18 is removable and insertable with cylinder heads received therein, in rotatable basket mount 62. Basket 18 is removably and rotatably mounted in chamber 12 according to the construction of the invention.

Still referring to FIG. 4, chamber 12 has an inlet 96 and an exhaust outlet 98. Located adjacent inlet 96 in cabinet 22 is a first forced air gas burner, or burner means 100 connected to a conventional gas supply (not shown). Burner 100 generates high-intensity flame-containing hot gas stream which is subsequently directed over cylinder heads being treated. Burner 100 in the preferred embodiment is an ECONOMITE Model DS20A, manufactured by Mid-Continent Metal Products Company of Chicago, Ill. Burner 100 is operably connected to inlet 96 which in turn has a burner pipe, or burner manifold, 102, operably connected thereto.

Manifold 102 includes an elongate, cylindrical tube 104 which is secured within chamber 12 at one end to inlet 96 and at the other end by a tube mount 106. Tube 104 has plural, flame passage openings 108 along its length. The openings are substantially rectangular voids cut in the dorsal aspect of the tube and occupy a majority of the length of the tube, leaving spacers 110 between openings 108. The end of tube 104 adjacent mount 106 is sealed by a plug 112.

In the preferred embodiment, baffles 114, 116 are provided for directing a flame produced by burner 100 upwards into chamber 12. The baffles are adjustable and are held in place by lock bolts 118, 120, received in threaded receptacles 122, 124, respectively.

Figure 6:
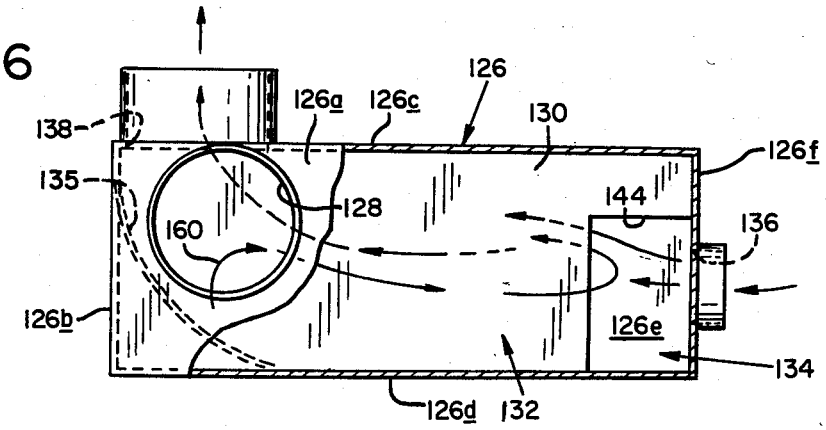
FIG. 6 is an enlarged plan view of an after-burning chamber, with portions broken away to show detail.
Figure 5:
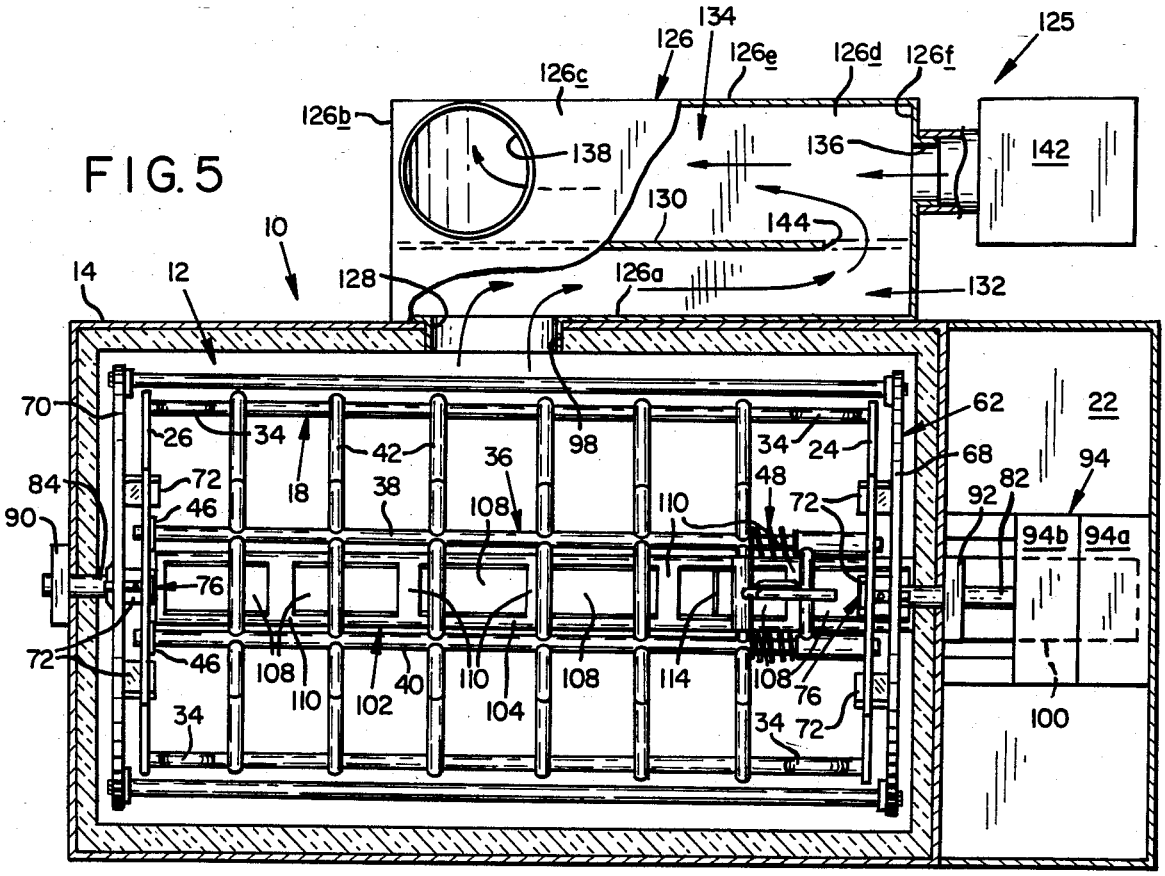
FIG. 5 is a top plan view of the cylinder head burner with portions broken away to show detail.

Turning now to FIGS. 5 and 6, an auxiliary burner, also referred to herein as pollutant reduction means, is shown generally at 125. Auxiliary burner 125 includes an after-burning chamber or enclosure 126. Chamber 126 is operably connected to exhaust outlet 98 and receives the gas stream generated by burner 100 after the gas stream has passed through chamber 12 and over the cylinder heads being treated in the chamber. Enclosure 126 has an entry port 128 formed in one side 126*a* thereof adjacent one end 126*b*. Enclosure 126 is a substantially box-like structure which is divided into plural cavities by a partition 130.

The first or entry cavity 132 is connected to the entry port and is formed between side 126*a* of the enclosure and partition 130. Partition 130 extends between the top 126*c* and bottomm 126*d* and extends a majority of the length of sides 126*a* and another side 126*e*. A second or after-burning cavity 134 extends between partition 130 and side 126*e*. A baffle 135 extends between bottom 126*d* and end 126*b* to direct the gas stream. A flame port 136 is located in another end 126*f* of the enclosure at an end of after-burning cavity 134. An exhaust port 138 is located adjacent one end 126*b* of the enclosure in the after-burner cavity for exhausting, through suitable duct work (shown at 140 in FIG. 1), the expended gas stream into the atmosphere.

Flame port 136 is operably connected to a second forced air gas burner 142, also referred to herein as auxiliary burner means which forms another part of auxiliary burner 125. Burner 142, in the preferred embodiment, is another ECONOMITE Model DS20A. Burner 142 provides a second high-intensity flame-containing hot gas stream to facilitate more complete incineration of the foreign matter initially burned off of the cylinder heads undergoing treatment.

Entry cavity 132 is connected with after-burner cavity 134 through a juncture, or connecting port, 144, formed in partition 130. Entry port 128 is of a known cross section, nine inches in the preferred embodiment, and connecting port 144 has a cross section opening 1.5 times the cross section of entry port 128. These relative sizes provide for the most efficient reduction of air stream pollutants.

Returning now to FIG. 1, control panel 23 includes a main or first burner timer 146, which has settings between zero and 30 minutes. An auxiliary or second burner timer 148 is adjustable between zero and 60 minutes. A thermostat/temperature indicator 150 is located between timers 146 and 148.

Pilot lights 152, 154 are located adjacent timers 146, 148, respectively, and are illuminated when the burners associated with the timers are in operation. Additionally, a main burner cycle indicator 156 is provided integrally with thermostat/temperature indicator 150 and illuminates when chamber 12 has reached the desired temperature. Thermostat/temperature indicator 150 is operably connected to a thermocouple 158, which is located in chamber 12 (FIG. 4).

Still referring to FIG. 1, a jog switch 159 is located on panel 23 and is operable to manually rotate basket mount 62 to a position where basket 18 may be lifted out of mount 62. Operation of motor 94*a* is normally controlled by main burner timer 146 such that whenever burner 100 is activated by timer 146, motor 94*a* causes mount 62 to rotate.

OPERATION

Describing now a typical operation cycle of the burner, cylinder heads may be placed on basket 18, which is removed from chamber 12, cross members 32 and secured in place by a first block retaining rack 36. Basket 18 may then be rotate 180° about its longitudinal axis and additional cylinder heads placed on cross members 32 on the side opposite those heads already in place. A second rack 36 would be positioned, thereby securing the second set of cylinder heads in place.

A harness, such as harness 20 in FIG. 1, may be attached to lifting eyes 34 and the entire basket lifted into chamber 12.

Basket 18 may then be secured to basket mount 62 by means of basket keepers 76. Once harness 20 is removed, lid 16 may be closed and the burner activated, beginning a first cleaning cycle. Hot gas flow through burning chamber 12 and after-burning chamber 126 is shown by arrows 160 in FIGS. 4 and 6.

If the burner is being used to clean cast iron cylinder heads, the chamber temperature is set to between 600° and 650° fahrenheit. If the heads being cleaned are aluminum castings, the temperature is set between 350° and 400° fahrenheit. In either case, the main burner is activated for a 30 minute cycle. Allowing for 10 to 15 minutes of warm up time for chamber 12 to reach the desired operating temperature, the cylinder heads are maintained at the desired temperature for 15 to 20 minutes. This time and temperature has been found to be sufficient to incinerate all oil, grease and other foreign matter from the cylinder heads.

The auxiliary burner is set for 35 to 40 minutes to insure that the air stream escaping the chamber, after shut down of the main burner, continues to be cleansed of pollutants. Specifically, the burner taught in the instant application has produced 50 ppm of CO when operated with only the main burner. Operation of the after burner reduces CO level to 37–38 ppm.

After the cleaning cycle is complete, and the after burner 142 has shut down, lid 16 may be opened, harness 20 attached, keepers 76 removed and basket 18 lifted from chamber 12. If desired, another basket may be loaded with cylinder heads to be cleaned during the first cleaning cycle and may be immediately loaded into the cleaning chamber upon completion of the first cycle. The second set of cylinder heads may be cleaned immediately, without the need to remove the first set of cylinder heads from the cleaning basket. This, of course, enables the cleaning cycles to follow one another quite closely, thereby not allowing chamber 12 appreciably to cool down in between cleaning cycles. This provides more efficient operation and requires less gas and electricity to operate the cylinder head burner.

Although the burner is designed to be operated with minimal observation, provision of indicator 156 provides the operator with an indication of chamber temperature. Once the chamber has reached the desired operating temperature, the timers may be adjusted to provide a 15 to 20 minute cleaning cycle from the time when the chamber first reaches desired operating temperature. Obviously, indicator 156 could be connected to an audible indicator which would more forcefully call the operators attention to the operating temperature of the burner.

Once basket 18 and the heads loaded therein have been removed from mount 62 and chamber 12, the heads may be allowed to cool in place in basket 18, or racks 36 may be removed, thereby allowing removal of the cylinder heads from the basket and, if desired, placement of yet another set of head to be cleaned in the basket. Provision of spring-biased abutments 48 on racks 36 allows easy removal of what may be extremely hot metal structures from the main portion of basket 18 with little danger of injury to the operators.

While a preferred embodiment of the instant invention has been disclosed herein, it is to be appreciated that modifications and variations may be made without departing from the spirit of the invention.

It is claimed and desired to secure by Letters Patent:

1. A burner for providing a hot gas stream and directing the stream over an object to be cleaned thereby, comprising:

burner means;

a burning chamber having an inlet operably connected to said burner means, a burner pipe connected to said inlet, and an outlet;

a basket for supporting the object within said chamber wherein said basket includes spaced-apart end plates having a plurality of bores therein, fastening means for fastening the object to be cleaned to said basket including spring-biased means for positioning said fastening means on at least one of said end plates and wherein said fastening means is removably fixable in said bores to accommodate objects of varying size; and means for removably mounting said basket in said chamber.

2. The burner of claim 1, wherein said spring-biasing means includes plug means removably receivable in said bores, means for shifting said plug means between a fixing position wherein said plug means are received in said bores and a releasing position wherein said plug means are withdrawn from said bores, and spring means to urge said plug means to said fixing position.

3. The burner of claim 2, wherein said means for shifting includes shiftable lever means, first pivotable means operably shiftable with said lever means, second pivotable means operably shiftable with said plug means, and connection means operably connecting said first and second pivotable means.

4. The burner of claim 3, wherein said fastening means further includes longitudinally extending, spaced apart portions and transversely extending portions fixed to said longitudinally extending portions; and wherein said plug means are slidable adjacent an end of said longitudinally extending portions; and where a collar is rotatably carried on one of said transversely extending portions adjacent said end of said fastening means, said lever means and said first pivotable means being fixed on said collar; means joining said plug means for simultaneous sliding, said second pivotable means being fixed on said means joining; said connecting means further having an elongate portion with a lug portion at each end thereof, one of said lug portions being pivotally received in said first pivotable means and the other of said lug portion being pivotally received in said second pivotable means.

5. The burner of claim 1 which further includes basket rotation means including a basket mount having spaced apart end pieces, and a drive unit operable to rotate said basket mount, said basket being removably receivable in said basket mount, and a basket keeper operable to removably secure said basket in said basket mount.

6. A burner for providing a hot gas stream and directing the stream over an object to be cleaned thereby, comprising:

burner means;

a burning chamber having an inlet operably connected to said burner means, a burner pipe connected to said inlet, an outlet, and basket rotation means therein, said basket rotation means including a basket mount having spaced apart end pieces and a drive unit operable to rotate said basket mount, said end pieces having a keeper bore therein;

an object-carrying basket removably received in said basket mount, said basket having spaced apart end plates receivable within said spaced apart ends of said basket mount, said end plates having keeper bores therein; and a basket keeper including pin means operable with said keeper bores to secure said basket to said basket mount.

7. The burner of claim 6 wherein said basket includes fastening means, and said end plates have plural bores therein, said fastening means being removably fixable in said bores to accommodate objects of varying size.

8. The burner of claim 6 which further includes pollutant reduction means including a forced air gas burner and an after-burning enclosure having an entry port connected to said outlet, a flame port connected to said gas burner, and an exhaust port, wherein said enclosure is a substantially box-like structure having spaced apart sides and ends, a top and a bottom, said entry port being located on one side thereof adjacent one end thereof, said exhaust port being located in the top thereof adjacent said one end, and said flame port being located in another end thereof, a partition extending between said top and bottom a majority of the length of said sides thereby defining an entry cavity adjacent said one side and an after-burning cavity adjacent said other side, said after-burning cavity being connected with said exhaust port and said flame port, said partition defining a connecting port allowing communication of said cavities adjacent another end of said enclosure, wherein said entry port is of a known cross-section and wherein said connecting port has a cross-section substantially 1.5 times that of said entry port.

9. The burner of claim 7, wherein said fastening means includes spring-biased means for positioning said fastening means on at least one of said end plates.

10. The burner of claim 9, wherein said spring-biasing means includes plug means removably receivable in said bores, means for shifting said plug means between a fixing position wherein said plug means are received in said bores and a releasing position wherein said plug means are withdrawn from said bores, and spring means to urge said plug means to said fixing position.

11. The burner of claim 10, wherein said means for shifting includes shiftable lever means, first pivotable means operably shiftable with said lever means, second pivotable means operably shiftable with said plug means, and connection means operably connecting said first and second pivotable means.

12. The burner of claim 11, wherein said fastening means further includes longitudinally extending, spaced apart portions and transversely extending portions fixed to said longitudinally extending portions; and wherein said plug means are slidable adjacent an end of said longitudinally extending portions; and where a collar is rotatably carried on one of said transversely extending portions adjacent said end of said fastening means, said lever means and said first pivotable means being fixed on said collar; means joining said plug means for simultaneous sliding, said second pivotable means being fixed on said means joining; said connecting means further having an elongate portion with a lug portion at each end thereof, one of said lug portions being pivotally received in said first pivotable means and the other of said lug portion being pivotally received in said second pivotable means.

* * * * *